US006963652B1

(12) United States Patent
Colombo

(10) Patent No.: US 6,963,652 B1
(45) Date of Patent: Nov. 8, 2005

(54) LOW FREQUENCY GENERATOR

(76) Inventor: James M Colombo, 2929 Fearstown Rd., Randolph, VA (US) 23962-3309

( * ) Notice: Subject to any disclaimer, the term of this patent is extended or adjusted under 35 U.S.C. 154(b) by 197 days.

(21) Appl. No.: 10/419,029

(22) Filed: Apr. 18, 2003

(51) Int. Cl.[7] ..... H04R 1/00
(52) U.S. Cl. ..... 381/418; 381/345
(58) Field of Search ..... 381/153, 156, 381/158, 165, 166, 345, 162, 417, 418, 419; 318/119; 340/388, 390, 391, 404; 455/153.1, 455/162.1, 354, 172.1; 310/27, 154, 264, 310/81

(56) References Cited

U.S. PATENT DOCUMENTS 2,069,242 A 2/1937 Graham
2,071,828 A 2/1937 Glen
2,517,727 A 8/1950 Smith
2,860,721 A 11/1958 Hassan
4,164,988 A 8/1979 Virva
4,471,173 A 9/1984 Winey
4,628,154 A 12/1986 Kort
5,734,132 A 3/1998 Proni
5,802,189 A * 9/1998 Blodget ..... 381/162
5,825,901 A 10/1998 Hisey
5,930,373 A 7/1999 Shashoua

* cited by examiner

*Primary Examiner*—Curtis Kuntz
*Assistant Examiner*—Brian Ensey
(74) *Attorney, Agent, or Firm*—Michael I Kroll

(57) ABSTRACT

A low frequency generator having a housing with a recess extending at least partially therethrough. A diaphragm is positioned within the recess and has at least one engagement device. A motor is positioned on an inner surface of the housing and extending substantially along the length of the housing. Upon activation of the motor, the motor engages the engagement device and selectively moves the diaphragm within the recess thereby generating a low frequency signal.

15 Claims, 6 Drawing Sheets

LOW FREQUENCY GENERATOR

BACKGROUND OF THE INVENTION

1. Field of the Invention

The present invention relates generally to sound equipment and, more specifically, to a low frequency generator comprising a housing having a recess extending therethrough and a diaphragm movable within the recess of the housing.

2. Description of the Prior Art

Numerous other sound generating devices designed for emitting a low frequency are present in the prior art. Typical of these are U.S. Pat. Nos. 2,069,242; 2,071,828; 2,517,727; 2,860,721; 4,164,988; 4,471,173; 4,628,154; 5,734,132; 5,825,901; and 5,930,373. While these sound generating devices may be suitable for the purposes for which they were designed, they would not be as suitable for the purposes of the present invention, as hereinafter described.

In an electro-acoustical energy converting system; a vibratory component, comprising an impulse responsive element; a flexing cylinder for mounting said element to permit piston-like vibration thereof and forming a fluid-tight junction therewith; a second component adapted for assembly with the first-named component, as a replaceable unit, and comprising adjustable means for supporting co-operating parts of said system; means for preliminarily coupling said components to permit adjustment and calibration of active elements at desired operating frequencies; and means to complete the coupling operation of the components in fluid-tight assembly with one another and without disturbing the adjustment.

In loud speakers and the like, the combination with a driving unit, of a driving diaphragm connected to be actuated by said unit, and a second diaphragm independently mounted in substantially parallel spaced relation to the first said diaphragm; the intervening space being in free communication with the atmosphere and of a width such that said second diaphragm is driven from the first solely by the acoustic vibration of the air in the space between said diaphragms.

A permanent magnet structure for a loudspeaker comprising a permanent magnet, a support therefore, a tip of magnetizable material but which is not a magnet, attached to the end of said magnet, a pole plate of magnetizable material carried by the support and enclosing at least portions of the magnet and pole tip, said pole tip having a thickness not less than half of that of the plate and not more than three quarters of that of the plate, said permanent magnet having anisotropic characteristics and said pole tip having isotropic characteristics, whereby the ratio of total useful flux to the volume of anisotropic material' is substantially a maximum.

A sound reproducing device comprising vibrating instrumentalities, a diaphragm operatively connected to said instrumentalities at its inner end and being unattached at its outer end, a support connected to said instrumentalities and spaced from said diaphragm, embodying an inwardly extending, attaching shelf at a point intermediate the outer and inner ends of said support, another shelf outwardly of said intermediate shelf and an outer rim outwardly of said other shelf, a gasket on said other shelf within said rim, and a flexible, expansible annular connector circumferentially attached to said diaphragm at a point intermediate the outer and inner ends thereof and attached to said attaching shelf, said diaphragm outer end being adjacent to and inwardly opposite said gasket and spaced therefrom.

A loudspeaker system is disclosed having a rigid framework which contains a high compliance loudspeaker connected to an adjustable air column tube. The adjustable air column tube provides exact ¼ wavelength tuning for the speaker system, to further improve its low frequency response, in accordance with tuned enclosure theory.

A planar diaphragm type magnetic transducer with an acoustically transparent magnetic backing, and a diaphragm overlying and spaced from the magnetic backing, the magnetic backing having magnetized strips lying parallel to each other and adjacent magnetized strips having opposite polarities at their faces confronting the diaphragm, the diaphragm being stiff and resisting flexing and connected by a flexible surround at its periphery.

An annular gap magnet system, in particular for a low frequency loudspeaker (Woofer), in which a coil is movable with a large stroke in the working air gap. A braking air gap provided in the region of the inner or lower pole plate produces a magnetic resistance in the pole plate so that a part of the magnetic flux flows over the braking air gap. This magnetic flux is opposed to the stray magnetic flux below the working air gap and excites a counter magnetic field which opposes further inward movement of the moving coil. In this way an impact of the moving coil against the inner or lower pole plate is prevented. In a low frequency loudspeaker the membrane carrying the moving coil may, therefore, be suspended extremely softly.

A concentric tube suspension system and loudspeaker system of the moving coil type, including a diaphragm supported by a frame, a voice coil including a former and voice coil winding supported by the former, and a suspension system for stabilizing and centering the voice coil in a magnetic gap while it is linearly displaced by an electromagnetic motor. The suspension system generally comprises a tubular stabilizer attached to the bottom surface of the diaphragm so as to concentrically straddle the voice coil and electromagnetic motor, and a lower corrugated suspension attached at one end to the frame and at the other end to the lower end of the stabilizer, wherein the stabilizer and lower suspension provide a centering force below the traditional neck joint location on the voice coil.

Apparatus (21) is described for reproducing low frequency sound in response to an applied electrical signal having a rotary acoustic radiator (22) comprised of a chamber (26) having a rotor assembly (58) including a shaft (61) and movable vanes (71, 72) secured to the shaft rotatably mounted in chamber for rotation on a longitudinal axis. Stationary vanes (62, 63) are mounted in the chamber and extend generally radially between the chamber walls and the shaft. The chamber has ports (64, 66, 67, 68) therein opening into the chamber and disposed adjacent the stationary vanes on opposite sides of said stationary vanes. The movable vanes are disposed on opposite sides of the stationary vanes and extend generally radially between the chamber walls and the shaft.

An apparatus for conveying to a listener a pseudo low frequency psycho-acoustic sensation (Pseudo-LFPS) of a sound signal, including: frequency unit capable of deriving from the sound signal high frequency signal and low frequency signal (LF signal) that extends over a low frequency range of interest. Harmonics generator coupled to the frequency generator and being capable of generating, for each fundamental frequency within the low frequency range of interest, a residue harmonic signal having a sequence of harmonics. The sequence of harmonics, generated with respect to each fundamental frequency contains a first group of harmonics that includes at least three consecutive harmonics from among a primary set of harmonics of the fundamental frequency. Loudness generator coupled to the harmonics generator and being capable of bringing the loudness of the residue harmonic signal to match the loudness of the low frequency signal. Summation unit capable of summing the residue harmonic signal and the high frequency signal so as to obtain psychoacoustic alternative signal.

SUMMARY OF THE PRESENT INVENTION

The present invention relates generally to sound equipment and, more specifically, to a low frequency generator comprising a housing having a recess extending therethrough and a diaphragm movable within the recess of the housing.

A primary object of the present invention is to provide a low frequency generator that overcomes the short comings of the prior art.

Another, secondary object of the present invention is to provide a low frequency generator having a housing with a movable diaphragm therein and wherein the diaphragm engages at least one linear motor.

A further object of the present invention is to provide a low frequency generator that moves molecules by moving a diaphragm by engaging the diaphragm with at least one linear motor within a housing.

Yet another object of the present invention is to provide a low frequency generator having a housing with a diaphragm having magnetic elements for preventing friction by repelling the diaphragm from the walls of the housing.

Still yet another object of the present invention is to provide a low frequency generator with a controller for reversing the polarity of the magnetic elements.

Another object of the present invention is to provide a low frequency generator wherein the controller has an electrical connection to an amplifier for amplifying the low frequency that is produced.

Additional objects of the present invention will appear as the description proceeds.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
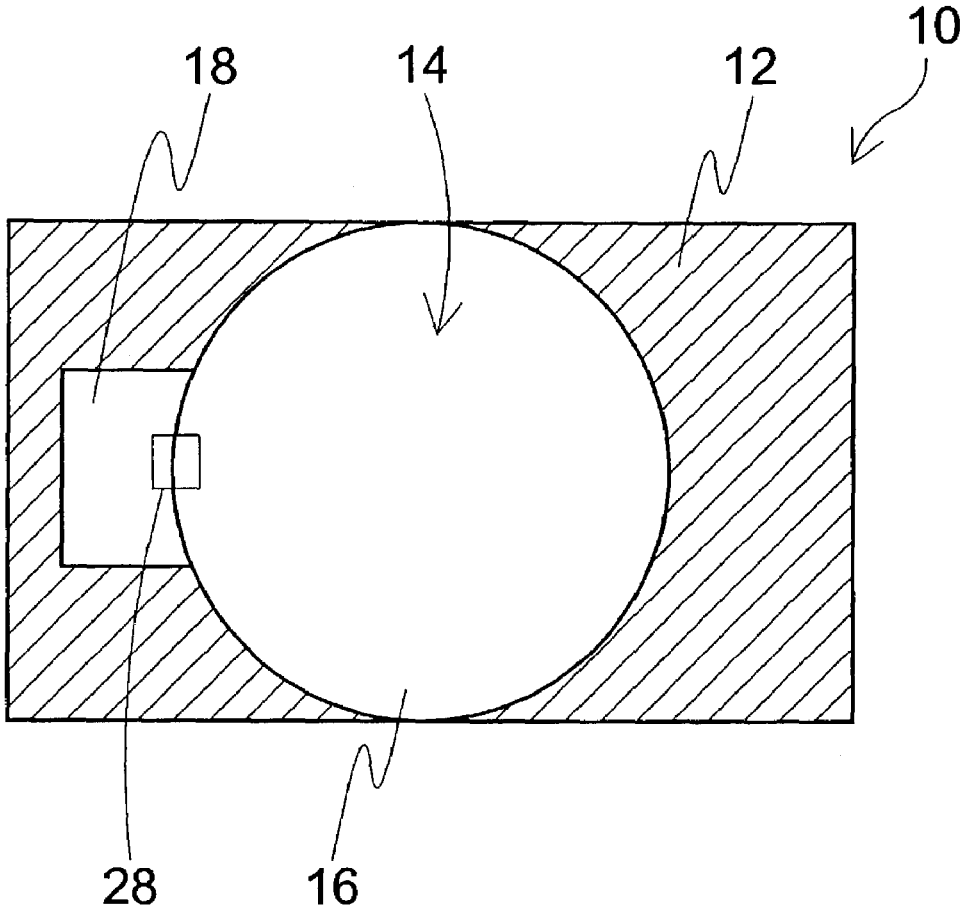
FIG. 1 is top view of the low frequency generator of the present invention.

Turning now descriptively to the drawings, in which similar reference characters denote similar elements throughout the several views, the Figures illustrate the low frequency generator of the present invention. With regard to the reference numerals used, the following numbering is used throughout the various drawing Figures.

10 low frequency generator of the present invention
12 housing
14 recess
15 repulsion device
16 diaphragm
18 motor
20 control unit
21 external unit
22 power supply
24 line out
25 connection wire
26 power cord
28 engagement device
30 aperture

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments. Practitioners skilled in the art will recognize numerous other embodiments as well. For a definition of the complete scope of the invention, the reader is directed to appended claims.

Turning now descriptively to the drawings, in which similar reference characters denote similar elements throughout the several views, FIGS. 1 through 6 illustrate a low frequency generator of the present invention generally by the numeral 10.

FIG. 1 is top view of the low frequency generator of the present invention. The low frequency generator 10 (hereinafter "generator") includes a housing 12 having a recess 14 extending at least partially therethrough. Preferably, the recess 14 is circular and extends entirely through the housing 12. However, the recess 14 may be formed in any shape and may extend at any distance through the housing 12. Positioned within the recess 14 is a diaphragm 16. As shown in FIG. 1, the diaphragm 16 is circular thereby matching the circular shape of the recess 14 of the housing 12. The diaphragm 16 has a diameter that is substantially equivalent to the diameter of the recess 14. At least one motor 18 is positioned adjacent the diaphragm 16 for engagement therewith via an engagement device 28. Upon activation of the motor 18, the motor 18 engages the diaphragm 16 via the engagement device 28 whereby the diaphragm 16 is caused to move through the recess 14 of the housing 12. The movement of the diaphragm 16 through the recess 14 causes the molecules within the recess to be moved. Upon the movement of molecules within the recess 14, a low frequency signal having a bass sound is produced. The resulting bass sound is generated at a very high output and a very low frequency.

Figure 2:
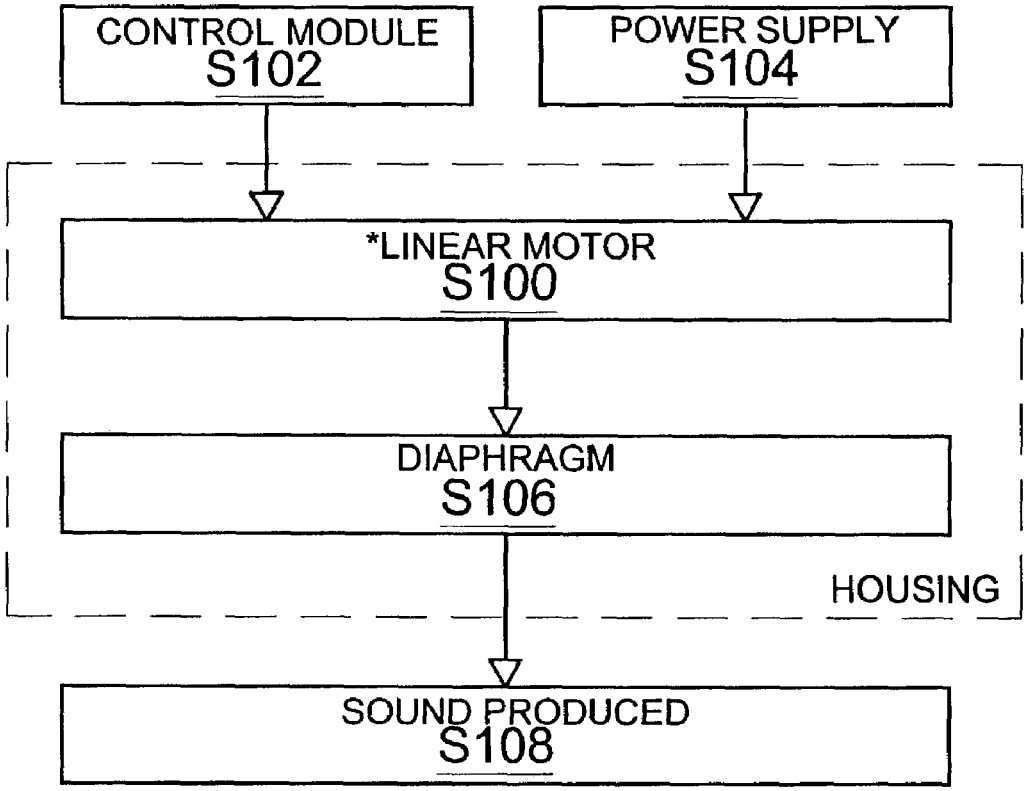
FIG. 2 is a flow chart detailing steps for moving molecules by the low frequency generator of the present invention.

FIG. 2 is a flow chart detailing how molecules are moved by the low frequency generator of the present invention. The low frequency bass signal is generated by at least one motor receiving two signal as indicated by step S100. The at least one motor is provided with a signal from a control unit as shown in step S102 and is also simultaneously provided with power from the power source as indicated in step S104. Upon receiving the simultaneous signals from steps S102 and S104, the at least one motor engages and moves the diaphragm as shown in step S106. Upon movement of the diaphragm by the at least one motor, a low frequency bass sound is generated as indicated by step S108.

Figure 3:
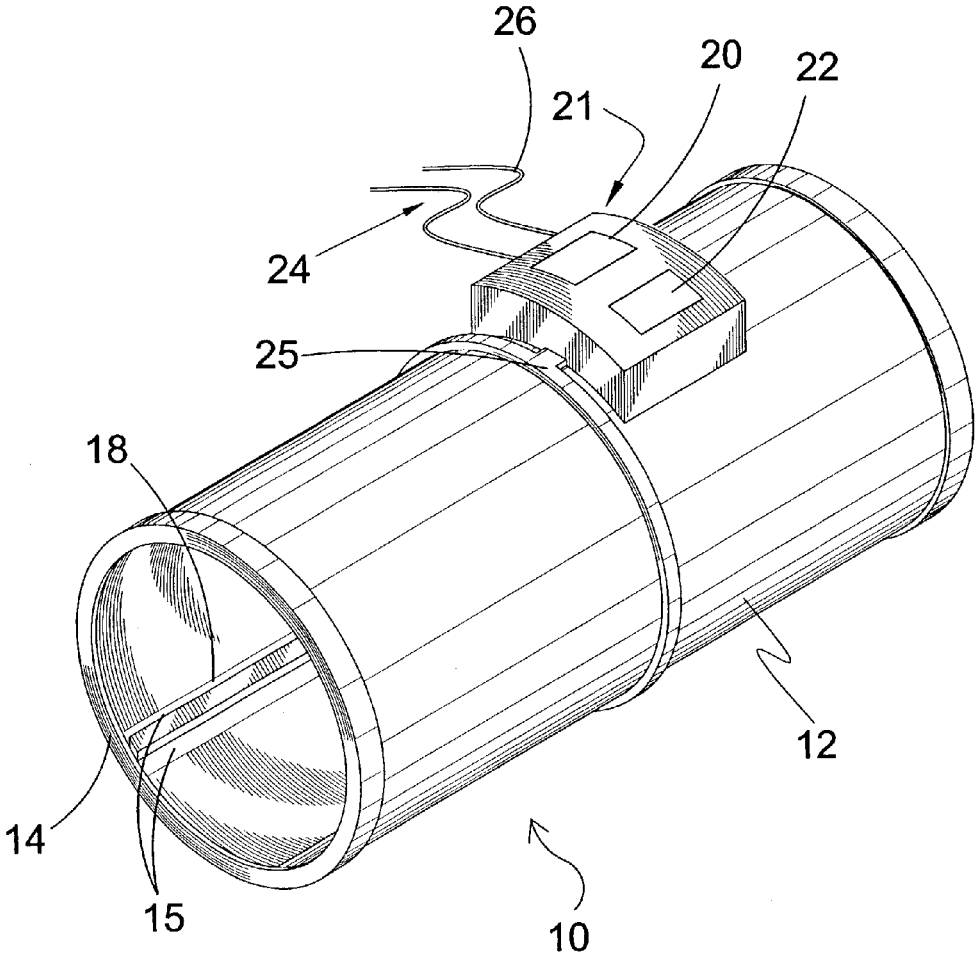
FIG. 3 is a perspective view of the low frequency generator of the present invention.

FIG. 3 is a perspective view of the low frequency generator of the present invention. The generator 10 of the present invention includes the housing 12. The housing 12 is shown in FIG. 3 as being cylindrical in shape and has a circular recess 14 extending entirely therethrough. The housing 12 is described as cylindrical and the recess 14 is described as circular for purposes of example only. In practice, the housing and recess can be formed in any desired shape. Positioned within the recess 14 of the housing 12 is the diaphragm 16. The diaphragm 16 is clearly shown in FIGS. 4-6. The positioning of the diaphragm 16 within the recess 14 causes the recess 14 to be divided into at least a first section and a second section. The first and second sections are positioned on opposite sides of the diaphragm 16. The size of the first and second sections is dependent upon the position of the diaphragm 16 within the recess 14 of the housing 12. The at least one motor 18 is positioned on an inner surface of the housing 12 and within the recess 14. The at least one motor 18 preferably extends along the entire length of the recess 14 of the housing 12 and engages the diaphragm 16 via an engagement device 28 therein. Preferably, there are a plurality of motors 18 positioned along the inner surface of the recess 14 of the housing 12 such that the plurality of motors 18 engage the diaphragm 16 via a plurality of engagement devices 28 positioned around the circumference of the diaphragm 16. Such will be discussed in greater detail hereinafter with specific reference to FIGS. 4-6.

Positioned adjacent to the at least one motor 18 is a repulsion device 15. The repulsion device 15 repels the diaphragm 16 from the inner surface of the housing 12 thereby preventing any unwanted friction when the diaphragm 16 is caused to move within the recess 14. The repulsion device 15 is at least one of a magnet, a slide, and high speed bearings. However, any means for preventing the diaphragm 16 from contacting the inner surface of the recess 14 may be used as a repulsion device 15. The repulsion device 15 allows for the diaphragm 16 to move quickly and easily within the recess 14 thereby producing the desired bass signals.

Optionally, a holding unit 21 is electrically connected to the housing 12 of the generator 10. The holding unit 21 includes a control module 20 and a power supply 22. The power supply 22 receives power from a standard external AC power source. However, the power supply 22 can be self-contained. The power supply 22 supplies power to the control until 20 as well as to the generator 10. The control unit 20 is selectively programmable by a user for operation of the motor 18. The control unit 20 selectively determines the speed at which the motor 18 operates at as well as the distance at which the diaphragm 16 is to be moved within the recess 14 of the housing 12. The control unit 20 thereby selectively controls the frequency which is emitted by the generator 10 of the present invention. Upon activation of the control unit 20, the at least one motor 18 is controlled to engage the diaphragm 16 via the engagement device 28 and thereby cause the diaphragm 16 to be moved within the recess 14 of the housing 12.

The holding unit 21 includes the control unit 20 and the power source 22 for receiving power from an external source via a power cord 26 extending therefrom. The control unit 20 and the power source 22 are electrically connected to the motor 18 and the housing 12 via a connection wire 25. The connection wire 25 allows power from the power source 22 to be provided to the at least one motor 18 for moving the diaphragm 16 within the recess 14. The control unit 20 controls the at least one motor 18 to move the diaphragm 16 within the recess 14 for producing low frequency bass signals. The holding unit 21 also has a line out 24 for connection to at least one of a pre-amplifier and an amplifier. The connection wire 25 also allows the low frequency signal produced from the movement of the diaphragm 16 to be transferred from the housing 12. Upon receiving the signal from the connection wire 25, the control unit 20 transfers the signal to the line out 24.

The actual frequency of the signal produced, as well as the duration of the signal produced is dependent upon the movement of the diaphragm within the recess. The at least one motor and repulsion device 15 allow for the diaphragm 16 to move freely and linearly within the recess 14. The control unit 20 controls the movement of the diaphragm and thus determines the signal that is output by the generator 10 of the present invention.

Figure 4:
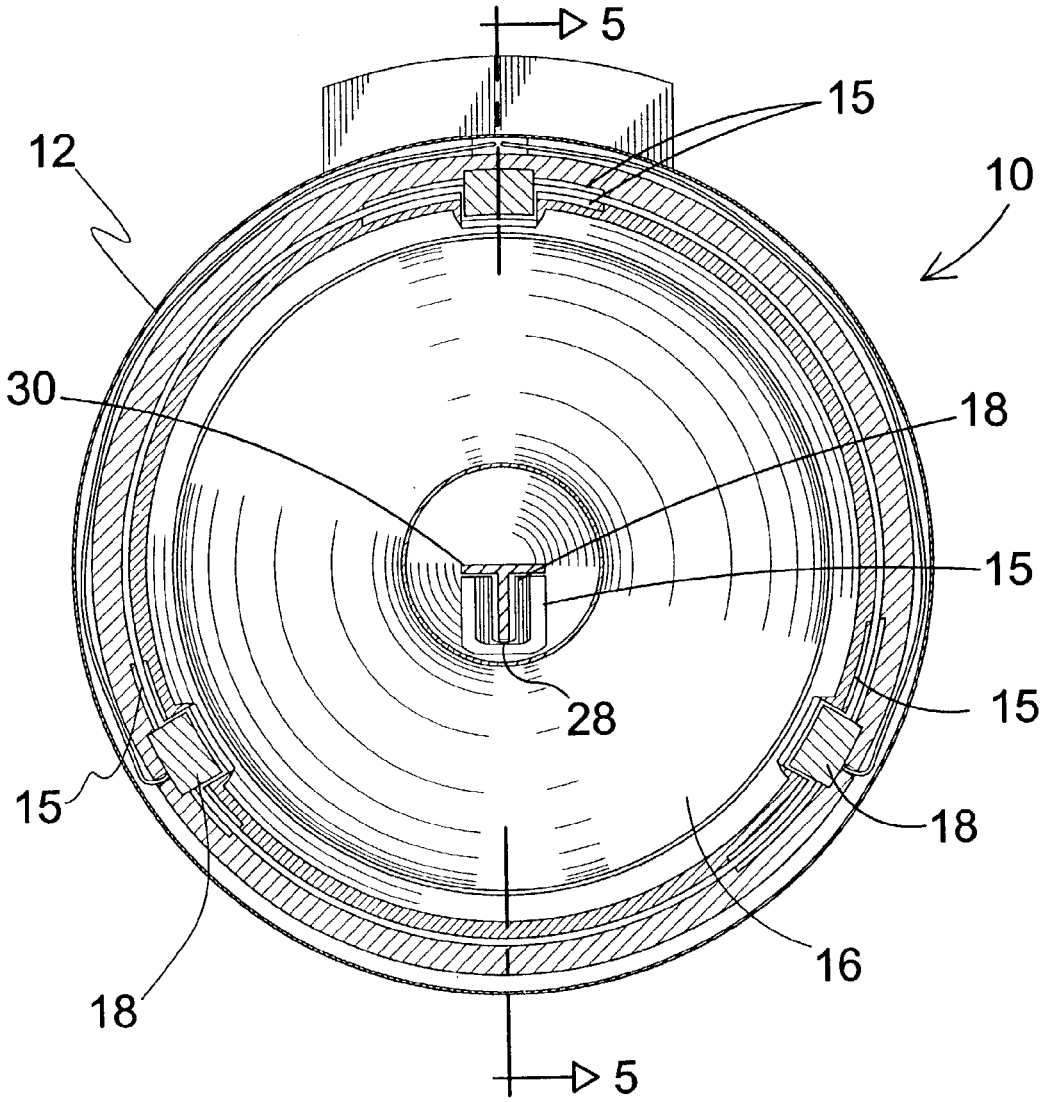
FIG. 4 is a side view of the low frequency generator of the present invention.

FIG. 4 is a side view of the low frequency generator of the present invention showing an end thereof. The generator 10 of the present invention includes the housing 12. The housing 12 is shown in FIG. 4 as being cylindrical in shape and has a circular recess 14 extending entirely therethrough. The housing 12 is described as cylindrical and the recess 14 is described as circular for purposes of example only. In practice, the housing and recess can be formed in any desired shape. Positioned within the recess 14 of the housing 12 is the diaphragm 16. The positioning of the diaphragm 16 within the recess 14 causes the recess 14 to be divided into at least a first section and a second section. The first and second sections are positioned on opposite sides of the diaphragm 16. The size of the first and second sections is dependent upon the position of the diaphragm 16 within the recess 14 of the housing 12. The at least one motor 18 is positioned on an inner surface of the housing 12 and within the recess 14. The at least one motor 18 preferably extends along the entire length of the recess 14 of the housing 12 and engages the diaphragm 16 via the engagement device 28 therein. Preferably, there are a plurality of motors 18 positioned along the inner surface of the recess 14 of the housing 12 such that the plurality of motors 18 engage the diaphragm 16 via a plurality of engagement devices 28 positioned around the circumference of the diaphragm 16.

Positioned adjacent to the at least one motor 18 is the repulsion device 15. The repulsion device 15 repels the diaphragm 16 from the inner surface of the housing 12 thereby preventing any unwanted friction when the diaphragm 16 is caused to move within the recess 14. The repulsion device 15 is at least one of a magnet, a slide, and high speed bearings. However, any means for preventing the diaphragm 16 from contacting the inner surface of the recess 14 may be used as a repulsion device 15. The repulsion device 15 allows for the diaphragm 16 to move quickly and easily within the recess 14 thereby producing the desired bass signals.

The holding unit 21 includes the control unit 20 and the power source 22 for receiving power from an external source via a power cord 26 extending therefrom. The control unit 20 and the power source 22 are electrically connected to the motor 18 and the housing 12 via a connection wire 25. The connection wire 25 allows power from the power source 22 to be provided to the at least one motor 18 for moving the diaphragm 16 within the recess 14. The control unit 20 controls the at least one motor 18 to move the diaphragm 16 within the recess 14 for producing low frequency bass signals. The holding unit 21 also has a line out 24 for connection to at least one of a pre-amplifier and an amplifier. The connection wire 25 also allows the low frequency signal produced from the movement of the diaphragm 16 to be transferred from the housing 12. Upon receiving the signal from the connection wire 25, the control unit 20 transfers the signal to the line out 24.

The generator 10, shown in FIG. 4, includes a plurality of motors 18 positioned equidistant from one another around the inner surface of the recess 14. Also, positioned adjacent each respective motor 18 is a repulsion device 15 for repelling the diaphragm 16 away from the interior surface of the recess 14 thereby preventing any unwanted friction during movement thereof. The diaphragm 16 has an aperture 30 for receiving an additional motor 18. The additional motor is T-shaped and it preferably extends the length of the housing 12. Similar to the plurality of motors along the inner surface of the recess 14, an additional repulsion device is positioned adjacent to the T-shaped motor 18. The T-shaped motor 18 received by the aperture 30 in the diaphragm 16 engages the diaphragm 16 via an engagement device 28. The motors 18 are controlled by the control unit 20 whereby the control unit 20 controls the motors 18 and moves the diaphragm 16 within the recess 14 of the housing 12 of the generator 10. This generates a low frequency bass signal.

Figure 5:
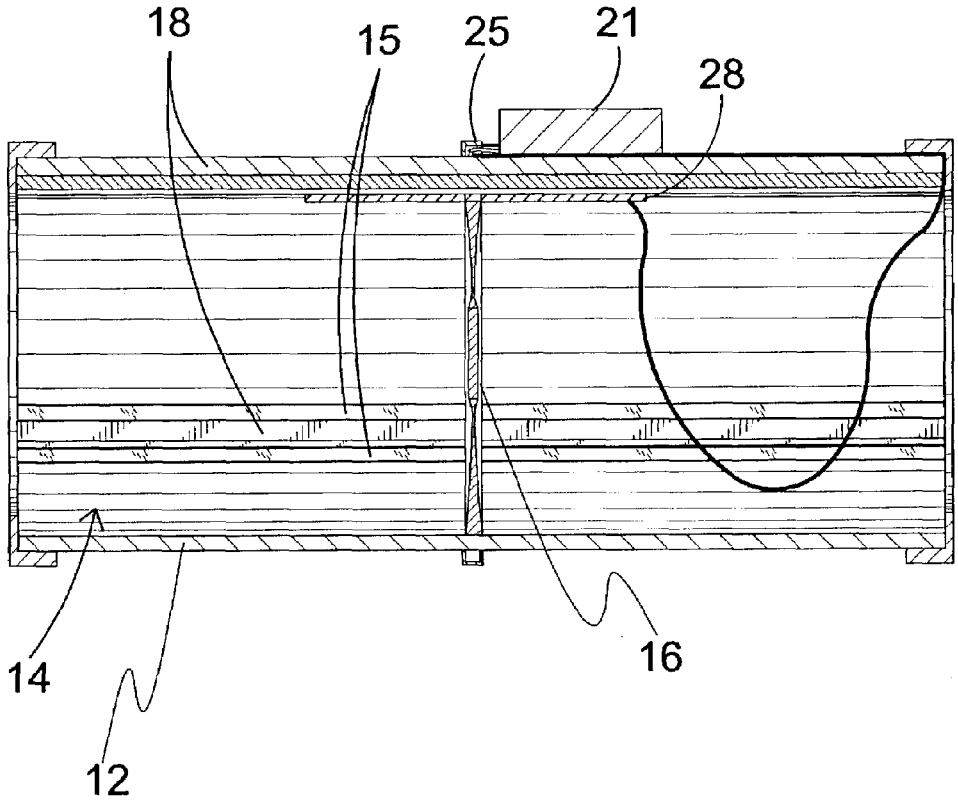
FIG. 5 is a cross-sectional view of the low frequency generator of the present invention.

FIG. 5 is a cross-sectional view of the low frequency generator of the present invention. The generator 10 of the present invention includes the housing 12 which, as shown in FIG. 5, is cylindrical and has a circular recess 14 extending entirely therethrough. The housing 12 is described as cylindrical and the recess is described as circular for purposes of example and the housing and recess can be formed in any shape. Positioned within the recess 14 of the housing 12 is the diaphragm 16. The positioning of the diaphragm 16 within the recess 14 causes the recess 14 to be divided into the first section and a second section. The size of the first and second sections is dependent upon the position of the diaphragm 16 within the recess 14 of the housing 12. The at least one motor 18 is positioned on an inner surface of the housing 12 and within the recess 14. The at least one motor 18 preferably extends along the entire length of the recess 14 of the housing 12 and engages the diaphragm 16 via the engagement device 28 therein. Preferably, there are a plurality of motors 18 positioned along the inner surface of the recess 14 of the housing 12 such that the plurality of motors 18 engage the diaphragm 16 via a plurality of engagement devices 28 positioned around the circumference of the diaphragm 16.

Positioned adjacent to the at least one motor 18 is the repulsion device 15. The repulsion device 15 repels the diaphragm 16 from contacting the inner surface of the housing 12 thereby preventing any unwanted friction when the diaphragm 16 is caused to move within the recess 14. The repulsion device 15 is at least one of a magnet, a slide, and high speed bearings. However, any means for preventing the diaphragm 16 from contacting the inner surface of the recess 14 may be used as a repulsion device. The repulsion device 15 allows for the diaphragm 16 to move quickly and easily within the recess thereby producing the desired bass signals.

The holding unit 21 includes control unit 20 and the power source 22 for receiving power from an external source via a power cord 26 which extends therefrom. The control unit 20 and the power source 22 are electrically connected to the motor 18 and the housing 12 via a connection wire 25. The connection wire 25 allows power from the power source 22 to be provided to the at least one motor 18 for moving the diaphragm 16 within the recess 14. The control unit 20 controls the at least one motor 18 to move the diaphragm 16 within the recess 14 for producing low frequency bass signals. The line out 24 connects the holding unit 21 to at least one of a pre-amplifier and an amplifier. The connection wire 25 also allows the low frequency signal produced from the movement of the diaphragm 16 to be transferred from the housing 12. Upon receiving the signal from the connection wire 25, the control unit 20 transfers the signal to the line out 24.

The housing 12 is split into the first section and the second section by the diaphragm 16. The relative size of the respective sections is dependent upon the positioning of the diaphragm 16 within the recess 14. The control unit 20 located within the holding unit 21 controls the at least one motor 18. The motor engages the diaphragm 16 via the engagement device 28 and causes the diaphragm 16 to move within the recess 14 of the housing thereby generating the desired low frequency bass signals.

Figure 6:
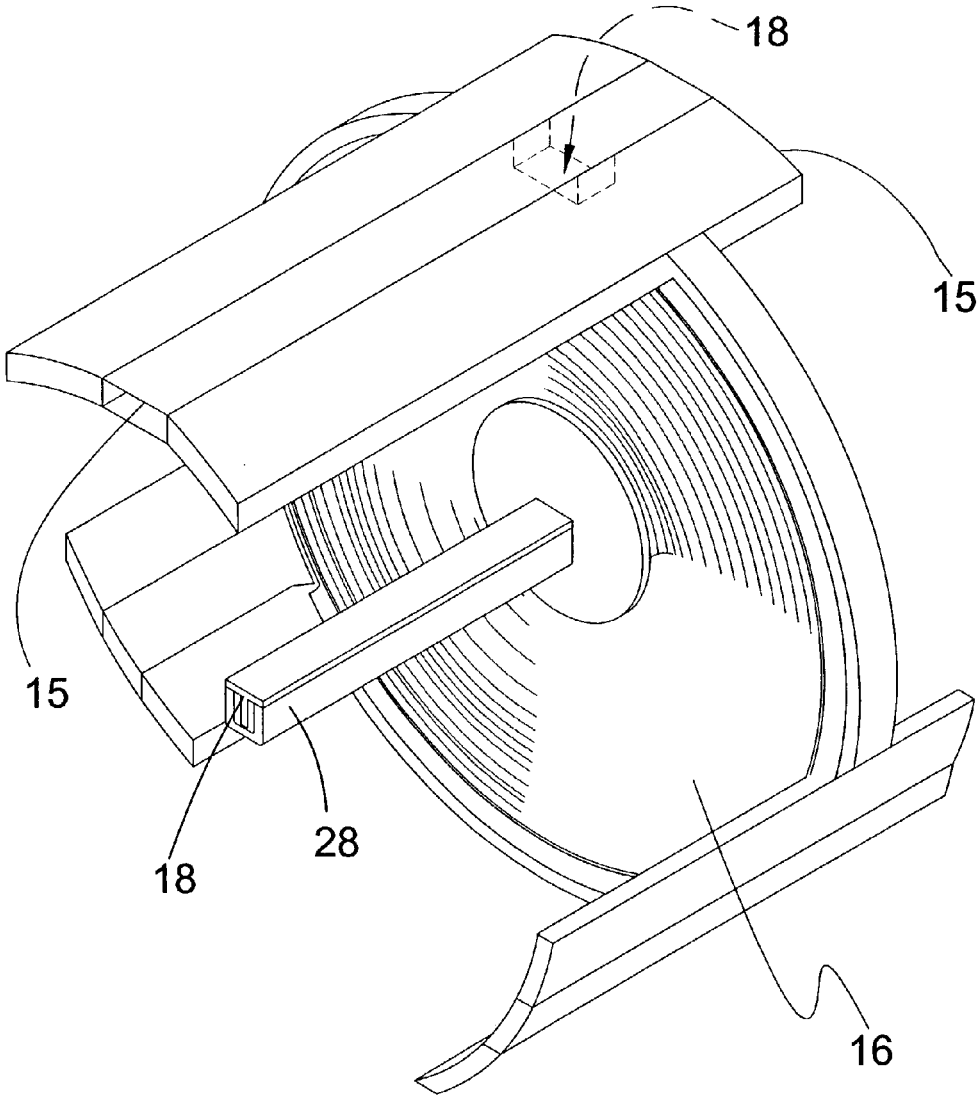
FIG. 6 is perspective view of the diaphragm engaged with the motor of the low frequency generator of the present invention.

FIG. 6 is left side perspective view of the diaphragm engaged with the linear motor of the low frequency generator of the present invention. The at least one motor 18 is positioned on an inner surface of the housing 12 and within the recess 14. The at least one motor 18 preferably extends along the entire length of the recess 14 of the housing 12 and engages the diaphragm 16 via an engagement device 28 therein. Preferably, there are a plurality of motors 18 positioned along the inner surface of the recess 14 of the housing 12 such that the plurality of motors 18 engage the diaphragm 16 via a plurality of engagement devices 28 positioned around the circumference of the diaphragm 16.

Positioned adjacent to the at least one motor 18 are repulsion devices 15. The repulsion devices 15 repel the diaphragm 16 from contact with the inner surface of the housing 12 thereby preventing any unwanted friction when the diaphragm 16 is caused to move within the recess 14. The repulsion device 15 is at least one of a magnet, a slide, and high speed bearings. However, any means for preventing the diaphragm 16 from contacting the inner surface of the recess 14 may be used as a repulsion device. The repulsion device 15 allows for the diaphragm 16 to move quickly and easily within the recess thereby producing the desired bass signals.

FIG. 6 shows the circular diaphragm 16 positioned within the recess 14 of the housing 12. The diaphragm 16 is shown to be engaged with a plurality of motors 18. Also shown are repulsion devices 15 positioned adjacent to the motors 18. FIG. 6 shows how the diaphragm 16 can move freely within the recess 14 of the housing 12 without generating unwanted friction by coming into contact with the inner surface of the recess 14.

From the above description it can be seen that the low frequency generator of the present invention is able to overcome the shortcomings of prior art devices by providing a low frequency generator that includes a housing having a recess and a diaphragm positioned within the recess. At least one motor is included on an inner surface of the recess for engaging and selectively moving the diaphragm therein. Upon moving the diaphragm within the recess, molecules are moved and compressed and a low frequency bass signal is generated and output by the generator of the present invention.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A low frequency acoustic generator comprising:

a) a housing having a recess extending at least partially therethrough;

b) a diaphragm positioned within said recess, said diaphragm having at least one engagement device; and c) a plurality of motors, each of said plurality of motors positioned on an inner surface of said housing and extending substantially along the length of said housing, wherein upon activation of said plurality of motors, said motors engage said engagement device and selectively move said diaphragm within said recess thereby generating a low frequency acoustic signal.

2. The low frequency generator as recited in claim 1, further comprising a holding unit positioned on said housing, said holding unit including a control unit and a power source.

3. The low frequency generator as recited in claim 2, wherein said control unit is connected to said housing and said plurality of motors for moving said diaphragm within said recess.

4. The low frequency generator as recited in claim 1, further comprising at least one repulsion device positioned adjacent at least one of said plurality of motors along said inner surface of said housing for preventing said diaphragm from contacting said housing.

5. The low frequency generator as recited in claim 1, wherein said housing is cylindrical in shape and said recess is circular.

6. The low frequency generator as recited in claim 1, wherein said plurality of motors is at least one of a linear motor, a general motor, a flat motor, a brush motor, an AC brushless motor, a stepper motor, an induction motor, and a servo motor.

7. The low frequency generator as recited in claim 6, wherein said plurality of motors is configured as at least one of a U-channel and a tubular shaped motor.

8. The low frequency generator as recited in claim 4, wherein said repulsion device is at least one of a magnet, a high speed bearing, and a slide.

9. The low frequency generator as recited in claim 1, wherein said diaphragm has an aperture positioned substantially in the center thereof for receiving at least one of said plurality of motors.

10. A low frequency acoustic generator comprising:

a) a housing having a recess extending at least partially therethrough;

b) a diaphragm positioned within said recess, said diaphragm having at least one engagement device;

c) a plurality of motors, each of said plurality of motors positioned on an inner surface of said housing and extending substantially along the length of said housing; and d) a control unit connected to said plurality of motors, wherein upon activation of said plurality of motors, said motors are caused to engage said engagement device and selectively move said diaphragm within said recess thereby generating a low frequency acoustic signal.

11. The low frequency generator as recited in claim 10, further comprising a holding unit positioned on said housing, said holding unit including said control unit and a power source.

12. The low frequency generator as recited in claim 10, further comprising a repulsion device positioned adjacent at least one of said plurality of motors along said inner surface of said housing for preventing said diaphragm from contacting said housing.

13. The low frequency generator as recited in claim 10, wherein said housing is cylindrical in shape and said recess is circular.

14. The low frequency generator as recited in claim 12, wherein said repulsion device is at least one of a magnet, a high speed bearing, and a slide.

15. The low frequency generator as recited in claim 10, wherein said diaphragm has an aperture positioned substantially in the center thereof for receiving at one of said plurality of motors.

* * * * *